US005149094A

United States Patent [19]

Tastad

[11] Patent Number: 5,149,094

[45] Date of Patent: Sep. 22, 1992

[54] PLAYER-OPERATED CONTROL SYSTEM FOR PINBALL GAMES

[75] Inventor: Gregory J. Tastad, Stone Park, Ill.

[73] Assignee: William Electronics Games, Inc., Chicago, Ill.

[21] Appl. No.: 741,228

[22] Filed: Aug. 5, 1991

Related U.S. Application Data

[63] Continuation of Ser. No. 551,277, Jul. 19, 1990, abandoned.

[51] Int. Cl.[5] ..... A63F 7/30

[52] U.S. Cl. ..... 273/121 A; 273/118 A; 273/119 A

[58] Field of Search ..... 273/118 R, 118 A, 119 R, 273/119 A, 120 R, 120 A, 121 R, 121 A, 122 R, 122 A, 123 R, 123 A, 124 R, 124 A, 125 R, 125 A

[56] References Cited

U.S. PATENT DOCUMENTS

| | | | |
|---|---|---|---|
| 3,275,324 | 9/1966 | Burnside | 273/121 A |
| 4,017,077 | 4/1977 | Burnside | 273/121 A |
| 4,109,916 | 8/1978 | Breslow et al. | 273/121 A |
| 4,162,793 | 7/1979 | Cummings | 273/121 A |
| 4,363,485 | 12/1982 | Edwall | 273/121 A |
| 4,375,286 | 3/1983 | Sietz et al. | 273/121 A |
| 4,508,343 | 4/1985 | Peters et al. | 273/119 A |

FOREIGN PATENT DOCUMENTS

| | | | |
|---|---|---|---|
| 8401908 | 5/1984 | World Int. Prop. O. | 273/121 A |

*Primary Examiner*—Paul E. Shapiro
*Assistant Examiner*—Raleigh W. Chiu
*Attorney, Agent, or Firm*—Rockey and Rifkin

[57] ABSTRACT

A player-operated control system for pinball games includes a plurality of switch assemblies by which the game player communicates information regarding the course of play to a controlling microprocessor. The software in the microprocessor alters the course of play according to the player's command.

1 Claim, 3 Drawing Sheets

PLAYER-OPERATED CONTROL SYSTEM FOR PINBALL GAMES

This is a continuation of copending application Ser. No. 07 551 277 filed on Jul. 12, 1990, abandoned.

BACKGROUND OF THE INVENTION

The present invention relates generally to pinball games, and more particularly to a player-operated system for controlling play options on pinball games.

Pinball games, as commonly known, consist of an inclined playfield and a plurality of play features arranged on the playfield. A player uses flippers or similar means to direct a pinball at playfield features such as targets or ramps in order to score points. Even though a variety of pinball game features are currently in use, constant addition of novel and exciting features is desirable to attract the greatest possible number of players to a particular pinball game.

In conventional pinball games, the player's only opportunity to influence the course of the game is by manipulation of the flippers to direct the pinball toward the various targets and playfield features. If the player fails to divert the ball by use of the flippers, the ball will exit the playfield under the force of gravity, ending the player's turn. Thus, conventional pinball games allow the player extremely limited control of game options.

OBJECTS AND SUMMARY OF THE INVENTION

Accordingly, it is a general object of the invention to provide a player-operated system for controlling various aspect of play on pinball games.

It is a further object of the invention to provide a player-operated system for pinball games that increases player appeal by allowing the player to have control of a greater number of aspects of play than is possible on conventional games.

It is another object of the invention to provide a player-operated system that is visually appealing and readily accessible to the player.

Other objects of the invention will become apparent to those skilled in the art from the detailed description of the invention provided below.

The present invention overcomes the above-mentioned shortcomings of the prior art by providing a player-operated system to allow the player to input option choices to control a variety of aspects of game play. The system gives the player access to a series of switches, which are mounted for ready access in the front molding of the pinball machine. When activated by the game player during his turn, the switches send an input signal to a microprocessor located in the game cabinet. The microprocessor is programmed to alter characteristics of game play according to the player's input.

The switches may be employed by the player to control aspects of game play if predetermined conditions (such as scoring a minimum number of points or sequentially activating a series of playfield features) are met during the course of a turn. The system may be configured to allow player control of any number of features, depending on the desired level of complexity of a given pinball game. The player-operated control system will give pinball machines greater variety and player appeal

DETAILED DESCRIPTION OF A PREFERRED EMBODIMENT

Figure 1:
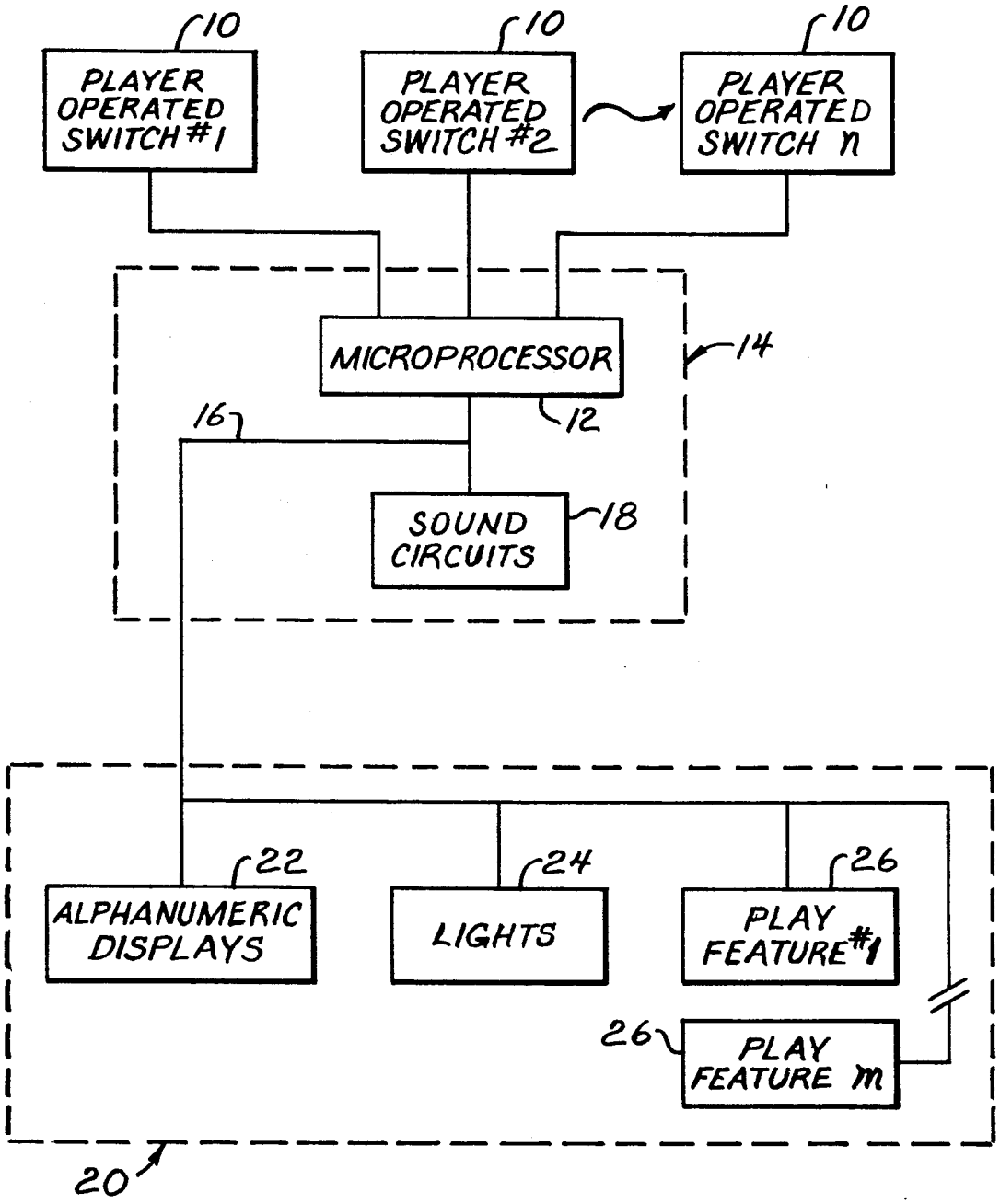
FIG. 1 is a block diagram representing the control system of the present invention.

Referring to the drawings, FIG. 1 shows a block diagram of the control system of the present invention. A plurality of player-operated switch assemblies 10 are provided to allow the pinball player to alter the course of play on the game playfield. The switches are configured and disposed so as to be activated by the player during the course of his turn. Each switch assembly 10 is associated with a switch contact, as will be fully described hereinafter. When activated, the switch assemblies 10 actuate the associated switch contacts to provide electronic input to a microprocessor 12, which monitors and controls various playfield conditions and activities according to system software programmed therein. The microprocessor 12 also registers appropriate scoring during the player's turn. An example of a microprocessor family suitable for this purpose is the Motorola 6800 series. The microprocessor 12 is programmed and configured to alter various aspects of game play based on input from the switches. The system elements enclosed by phantom line 14 are contained in the pinball game cabinet. The elements enclosed by phantom line 20 are disposed on the pinball game playfield or in the back box (see FIG. 2). The button assemblies 10 are mounted on the front molding of the game cabinet.

The microprocessor 12 is interfaced via a bus 16 to various elements of the pinball game, such as sound circuits 18, alphanumeric displays 22, lights 24, and play features 26. Such a bus structure is well known in the art of microcomputer architecture. The player-operated system of the present invention may exercise control over any or all of the play elements connected to the bus structure 16. The specific control of the various game elements is determined by the software program executed by the microprocessor 12. The microprocessor may be programmed to allow the player to control any game element desired.

Additionally, the pinball game designer may devise the game software executed by the microprocessor to allow alteration of elements connected to the microprocessor bus structure in any combination based on input from the player operated system. If the player is given the opportunity to alter the physical configuration of a playfield feature (for example, resetting a series of drop targets or changing the mode of a multiple-mode ball diverter play feature), the software may be structured to cause the microprocessor to enhance the audiovisual effect of the player's choice by activating sound circuits 18, updating the information contained in alphanumeric displays 22, or turning on lights 24 in the game environment. These effects add visual excitement to the game, resulting in greater player appeal.

Furthermore, the microprocessor may be programmed to respond to input from the player-operated system by performing data manipulation without altering any game elements connected to the bus structure.

For example, the player-operated system may be structured to allow the player to reallocate scoring multipliers, which compound the nominal point value awarded for activation of various playfield features. The reallocation could be accomplished by temporary modification of data contained in the microprocessor memory. The change in data would be transparent to the game player, except that scoring during the player's turn would be calculated according to the player's input into the system of the present invention, rather than according to the default scheme stored in system memory.

Figure 2:
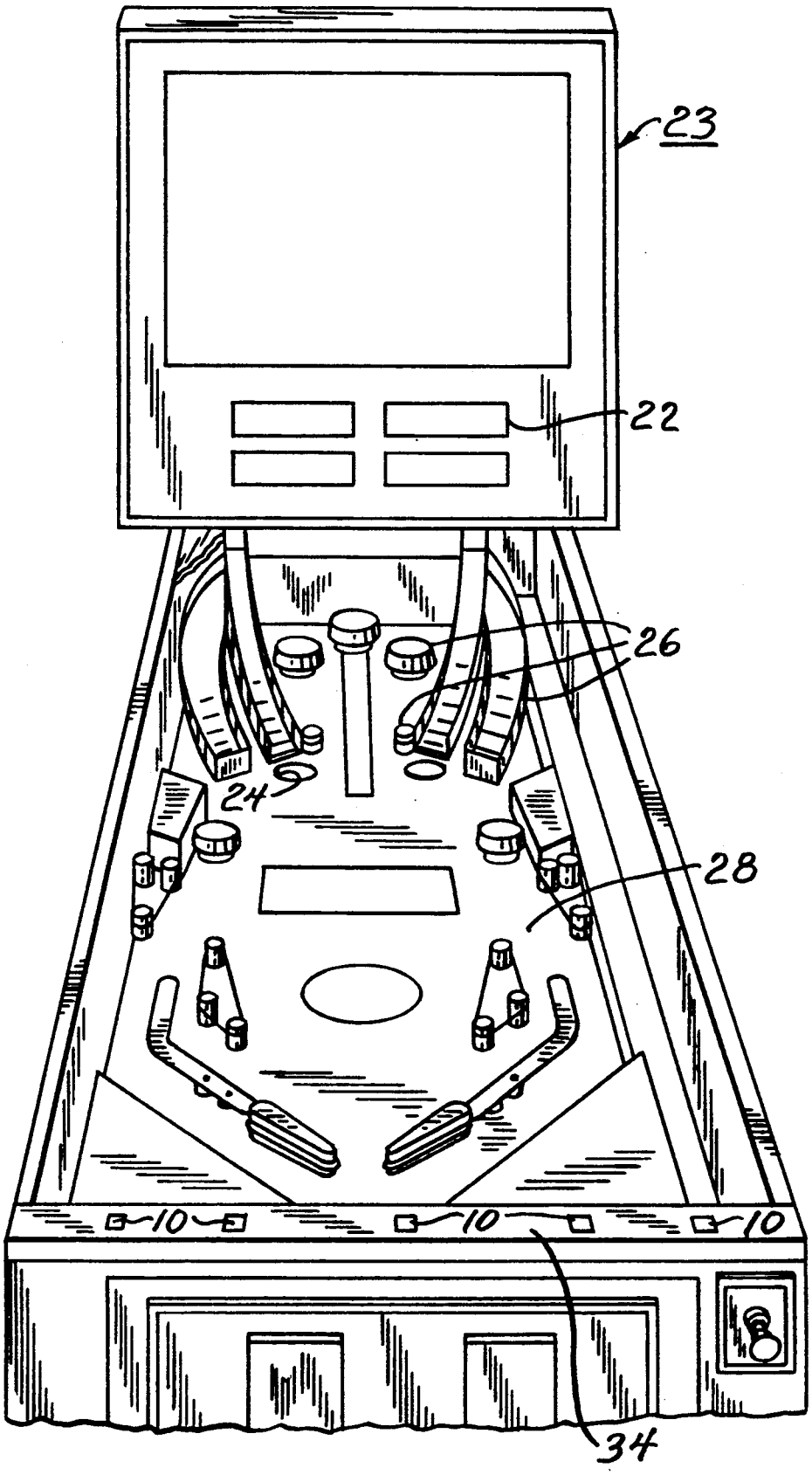
FIG. 2 is a perspective view of a pinball machine having the present invention installed thereon.

FIG. 2 shows a pinball game having the control system of the present invention. The playfield 28 is downwardly sloping and is equipped with a variety of lights 24 and play features 26 as described with reference to FIG. 1. Alphanumeric displays 22 are disposed on the back box 23. The player-operated control system of the present invention includes several switches 10 secured in a front molding 34, which is mounted in a player-accessible orientation on the upper surface of the pinball machine.

Figure 3:
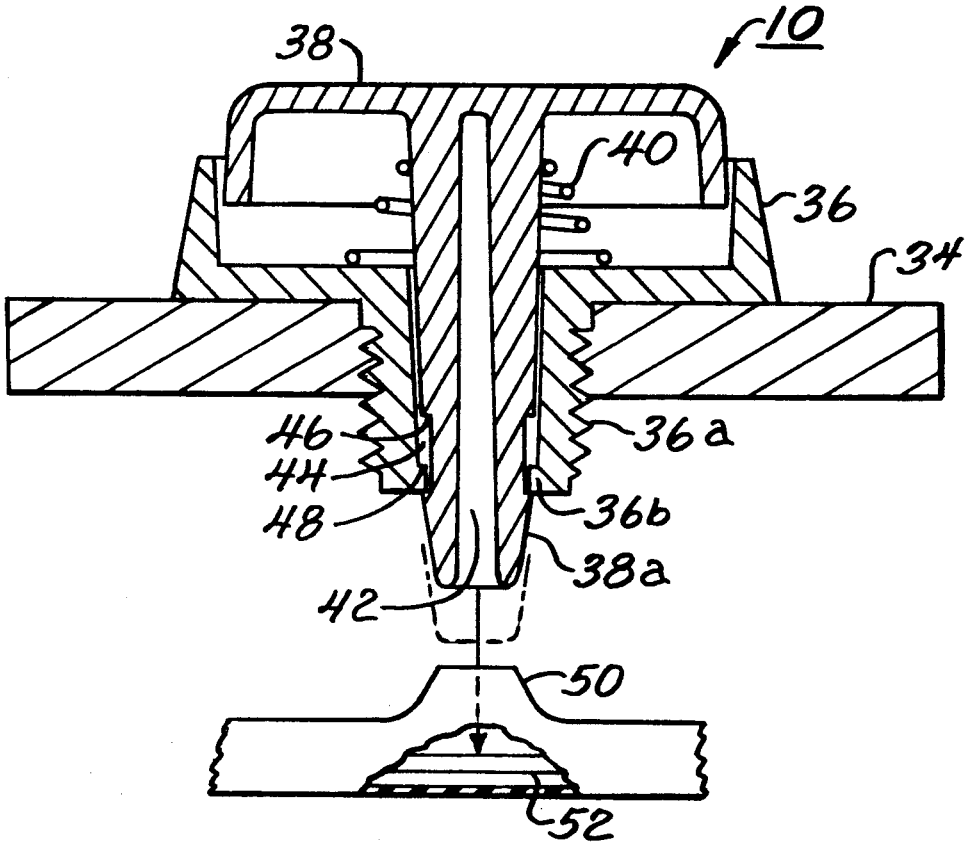
FIG. 3 is a side view in section showing a switch assembly used in the present invention

FIG. 3 shows the construction of one embodiment of a switch 10 for use in the present invention. The switch includes a base 36, having a threaded portion 36*a* and a ledge 36*b*, which is threadably secured by threaded portion 36*a* in an aperture formed in the front molding 34. A button 38, having a post portion 38*a*, is press fitted into the base 36 as will hereinafter be described. During assembly, a spring 40 is concentrically disposed around a post portion 38*a* of the button 38 such that the spring is positioned between the top of the base 36 and the bottom of the button 38.

A hollow cavity 42 is formed in the post portion 38*a* to allow the sides of the post portion 38*a* to be displaced inwardly as the button 38 is pushed into the base 36 during assembly. The post portion 38*a* also has an annular recess 44 circumscribing its periphery to create a first shoulder 46 and a second shoulder 48. The sides of the post portion 38*a* snap back into place when the ledge 36*b* engages the recess 44 located in the post portion 38*a*. As is evident from the foregoing discussion, the movement of the button 38 within the base 36 is limited by the engagement of the shoulders 46 and 48 with the ledge 36*b*.

In the disclosed embodiment, each switch 10 is associated with a switch actuator 50. The actuators for all switches may be formed from a single rubber pad, as will be understood by one having ordinary skill in the art. A conductive switch contact 52 is disposed beneath each actuator 50. The distal end of the post portion 38*a* is positioned above the associated actuator 50. The spring 40 biases the button 38 to a non-actuated position. When the button 38 is depressed, the spring 40 is compressed between the base 36 and the button 38. The post portion 38*a* descends, compressing the corresponding switch actuator 50. The actuator 50 closes the switch contacts 52, completing an electrical circuit which sends a digital signal to the microprocessor as previously described.

As previously noted, any number of switches 10 may be deployed in the molding 34, depending on the number and complexity of features subject to button control. In the disclosed embodiment, all switch assemblies are substantially similar in construction and operation.

In operation of the system, the pinball player uses conventional apparatus to cause the pinball to enter the playfield. If the microprocessor determines that the player has met certain predetermined conditions during a turn, the player is given the option of affecting game play by employing the player-operated switches. The conditions are featured goals for the player to attain. As noted previously, the predetermined conditions may be, for example, attaining a specified minimum score or activating a specific play feature or series of playfield features. After fulfilling a given condition, the player will have the option, for example, to risk a certain number of points on the outcome of activity on the playfield. The player-operated system will allow the player to input the number of points he wishes to wager by actuation of the corresponding switch assembly. As will be apparent to one having ordinary skill in the art, the player-operated system can be used to control a variety of play options at the discretion of the designer of the specific pinball game.

The present invention has been described with respect to certain embodiments and conditions, which are not meant to limit the invention. Those skilled in the art will understand that variations from the embodiments and conditions described herein may be made without departing from the invention as set forth in the appended claims.

What is claimed is:

1. In a pinball game of the type having a pinball that rolls freely on a downwardly sloping playfield, flipper mechanisms for diverting the travel of the ball to prevent the ball from exiting the playfield under the force of gravity through an outhole, a plurality of features on the playfield including bumpers, targets and lamps, and a microprocessor for controlling the operation of the pinball game by the execution of a software program, such control including monitoring scoring during the player's turn the improvement comprising:

a) a plurality of player-operated switches mounted on the end of the pinball game adjacent to the game player for signalling the microprocessor during the course of the player's turn, and;

b) software means executable by the microprocessor for altering the operation of selected features on the playfield according to the signal received from the player-operated switches during the course of the player's turn, each time the player achieves predetermined game objectives.

* * * * *